US006019173A

United States Patent [19]

Saurer et al.

[11] Patent Number: 6,019,173

[45] Date of Patent: Feb. 1, 2000

[54] MULTILATERAL WHIPSTOCK AND TOOLS FOR INSTALLING AND RETRIEVING

[75] Inventors: Dan P. Saurer, Richardson; David J. Steele, Irving, both of Tex.; Ken Horne, Aberdeen, United Kingdom

[73] Assignee: Dresser Industries, Inc., Dallas, Tex.

[21] Appl. No.: 09/054,366

[22] Filed: Apr. 2, 1998

Related U.S. Application Data

[60] Provisional application No. 60/043,902, Apr. 4, 1997.

[51] Int. Cl.[7] ..... E21B 7/08; E21B 31/12

[52] U.S. Cl. ..... 166/98; 166/117.6; 166/377

[58] Field of Search ..... 166/50, 98, 117.5, 166/117.6, 313, 377; 294/86.19, 86.17, 86.24

[56] References Cited

U.S. PATENT DOCUMENTS

| | | | |
|---|---|---|---|
| 2,338,788 | 1/1944 | Walker | 166/117.6 |
| 2,397,070 | 3/1946 | Zubling . | |
| 2,797,893 | 7/1957 | McCune et al. . | |
| 2,804,926 | 9/1957 | Zublin | 166/50 |
| 2,858,107 | 10/1958 | Colmerauer . | |
| 4,420,049 | 12/1983 | Holbert | 175/45 |
| 4,767,145 | 8/1988 | Bullard | 294/86.19 X |
| 4,848,820 | 7/1989 | Morrell | 294/86.18 |
| 5,113,938 | 5/1992 | Clayton | 166/117.6 |
| 5,222,554 | 6/1993 | Blount et al. | 166/117.6 |
| 5,311,936 | 5/1994 | McNair et al. | 166/50 |
| 5,318,121 | 6/1994 | Brockman et al. | 166/313 |
| 5,325,924 | 7/1994 | Bangert et al. | 166/313 |
| 5,335,737 | 8/1994 | Baugh | 166/117.6 X |
| 5,388,648 | 2/1995 | Jordan, Jr. | 166/380 |
| 5,398,754 | 3/1995 | Dinhoble | 166/117.6 |
| 5,425,419 | 6/1995 | Sieber | 166/206 |
| 5,427,177 | 6/1995 | Jordan, Jr. et al. | 166/50 |
| 5,431,219 | 7/1995 | Leising et al. | 166/50 |
| 5,467,819 | 11/1995 | Braddick | 166/117.6 |
| 5,474,131 | 12/1995 | Jordan, Jr. et al. | 166/313 |
| 5,477,925 | 12/1995 | Trahan et al. | 166/382 |
| 5,484,017 | 1/1996 | Coon | 166/117.5 |

(List continued on next page.)

FOREIGN PATENT DOCUMENTS

| | | |
|---|---|---|
| 0 701 040 A2 | 3/1996 | European Pat. Off. . |
| 2 297 988 | 1/1996 | United Kingdom . |
| WO97/07318 | 1/1997 | WIPO . |

OTHER PUBLICATIONS

International Search Report, Patent Cooperation Treaty, mailed Jul. 29, 1998, for PCT/US98/06603.

(List continued on next page.)

*Primary Examiner*—George Suchfield
*Attorney, Agent, or Firm*—Konneker & Smith, Esq

[57] ABSTRACT

An improved tubing exit whipstock and tools for installing and retrieving the whipstock are provided for directing movement of well tools from a first wellbore to a second wellbore extending therefrom. The tubing exit whipstock may include a generally cylindrical deflector body with a longitudinal passageway extending therethrough. The deflector body may also include a tapered surface for deflecting well tools from the first wellbore to the second wellbore. In one embodiment of the present invention, a mechanical connector may be provided for attaching the deflector body to an orienting and locking device to releasably install the whipstock at a selected downhole location. In another embodiment, a first fishing neck profile may be provided within the longitudinal passageway to provide means for releasably coupling the deflector body with a running tool for installing the tubing exit whipstock at a selected downhole location within the first wellbore. In yet another embodiment, the fishing neck may provide means for releasably coupling the deflector body with a pulling tool for removing the tubing exit whipstock from the selected downhole location within the first wellbore.

17 Claims, 6 Drawing Sheets

U.S. PATENT DOCUMENTS

| | | | |
|---|---|---|---|
| 5,520,252 | 5/1996 | McNair | 166/313 |
| 5,533,573 | 7/1996 | Jordan, Jr. et al. | 166/313 |
| 5,535,822 | 7/1996 | Schock et al. | 166/50 |
| 5,564,503 | 10/1996 | Longbottom et al. | 166/313 |
| 5,639,135 | 6/1997 | Beeman | 294/86.17 |
| 5,649,595 | 7/1997 | Davis et al. | 166/297 |
| 5,651,415 | 7/1997 | Scales | 166/250 |
| 5,678,634 | 10/1997 | Rehbock et al. | 166/377 |
| 5,697,445 | 12/1997 | Graham | 166/313 |
| 5,715,891 | 2/1998 | Graham | 166/313 |
| 5,730,224 | 3/1998 | Williamson et al. | 166/386 |
| 5,806,614 | 9/1998 | Nelson | 175/61 |
| 5,839,518 | 11/1998 | Gano et al. | 166/117.6 X |
| 5,871,046 | 2/1999 | Robison | 166/117.6 X |
| 5,884,698 | 3/1999 | Hughes et al. | 166/117.6 |

OTHER PUBLICATIONS

PCT International Search Report for Int'l Application No. PCT/US98/06658 filed on Apr. 3, 1998.

PCT International Search Report for Int'l Application No. PCT/US98/06653 filed on Apr. 3, 1998.

Schlumberger Horizontal Well—Complete Analysis: Production Logging, DEFT Specifications, Mar. 10, 1997, 2 pages.

PCE Advertisement Thru Tubing Multi Lateral Re–Entry System (MLR™), 1995© (one page).

Inpadoc/Fam. & Legal Stat. 1998 Report (five pages).

Great Britain Journal of Patents, Nov. 13, 1996, *Official Journal* (*Patents*) (one page).

MULTILATERAL WHIPSTOCK AND TOOLS FOR INSTALLING AND RETRIEVING

RELATED APPLICATIONS

This application claims the benefit of U.S. Provisional application Ser. No. 60/043,902 filed Apr. 4, 1997.

This application is related to provisional patent application Ser. No. 60/042,170 filed Mar. 31, 1997, and entitled *Lateral Re-Entry System,* now abandoned; patent application Ser. No. 09/054,365 filed Apr. 2, 1999 and entitled *Method and Apparatus for Deploying a Well Tool into a Lateral Wellbore* which claims priority from U.S. Ser. No. 60/042,927 filed Apr. 4, 1997 and patent application Ser. No. 09/054,367 filed Apr. 2, 1999 and entitled *Window Assembly for Multiple Wellbore Completions* which also claims priority from U.S. Ser. No. 60/042,927 filed Apr. 4, 1997.

TECHNICAL FIELD OF THE INVENTION

The present invention relates generally to equipment for use with a well having a vertical wellbore and at least one lateral wellbore, and more particularly, to an improved whipstock for installation adjacent to a lateral wellbore, and tools for installing and retrieving the whipstock.

BACKGROUND OF THE INVENTION

During the past several years, substantial improvements have been made in three dimensional (3D) seismic surveys to better locate and define the boundaries of underground hydrocarbon producing formations. During this same time period, substantial improvements have also been made in directional drilling and horizontal well completion techniques. As a result, many current well completions often include more than one wellbore or borehole. For example, a first, generally vertical wellbore may be initially drilled within or adjacent to one or more hydrocarbon producing formations. Multiple wellbores may then be drilled extending from the vertical wellbore to selected locations designed to optimize production from the hydrocarbon producing formation or formations. Such well completions are often referred to as multilateral wells.

A typical multilateral well completion will include a generally vertical or primary wellbore defined in part by a casing string and a layer of cement disposed between the exterior of the casing string and the inside diameter of the primary wellbore. Directional drilling equipment and techniques may be used to form an exit or window in the casing string and layer of cement at a downhole location selected for drilling a lateral or secondary wellbore from the primary wellbore. The location of the window from the primary wellbore, the orientation of the window, the length and diameter of the secondary wellbore and the orientation of the secondary wellbore relative to the primary wellbore and the hydrocarbon producing formation are selected based on characteristics of the associated hydrocarbon producing formation. For many locations such as deep offshore wells, multiple secondary or lateral wellbores will be drilled from each vertical wellbore in an effort to optimize hydrocarbon production while minimizing drilling and completion costs. Selective isolation and/or reentry into each of the secondary or lateral wellbores is often necessary to further optimize production from the associated hydrocarbon producing formations or formation.

A typical multilateral well completion will have one or more production tubing strings disposed within the casing string of the primary wellbore. The production tubing string or strings will have a generally uniform inside diameter extending from the well surface to a selected downhole location. A reentry window assembly, sometimes referred to as a lateral reentry window, will be installed within each production tubing string at a downhole location corresponding with the location at which a secondary or lateral wellbore intersects the primary wellbore. For example, a multilateral well completion may have a first wellbore or primary wellbore with three secondary or lateral wellbores intersecting the primary wellbore at respective first, second and third downhole locations. A production tubing string with three window assemblies may be installed within the casing string of the primary wellbore using conventional well completion techniques such that each window assembly is disposed adjacent to a respective lateral or secondary wellbore.

In order to deflect well tools from the primary wellbore into a preselected lateral wellbore, a tubing exit whipstock is installed within the primary wellbore at a location adjacent to the preselected lateral wellbore. The surface of the tubing exit whipstock is tapered toward the lateral wellbore to provide a smooth transition. Existing tubing exit whipstocks include a semitubular neck attached to the whipstock at one end and provide a collar with a grooved profile for connection to an installation for retrieving a tool at another end. The diameter of the collar containing the grooved profile limits the diameter of any downhole tool which must pass through the collar to enter the lateral wellbore.

SUMMARY OF THE INVENTION

In accordance with teachings of the present invention, an improved tubing exit whipstock and tools for installing and retrieving the whipstock are provided to substantially reduce or eliminate problems previously associated with the prior tubing exit whipstocks and their associated tools for installing and retrieving.

One embodiment of the present invention includes a tubing exit whipstock for directing the movement of well tools from a first wellbore to a second wellbore extending therefrom. The tubing exit whipstock may comprise a generally cylindrical deflector body with a longitudinal passageway extending therethrough. The deflector body may also comprise a tapered surface for deflecting well tools from the first wellbore to the second wellbore. In one embodiment of the present invention, a mechanical connector is provided for attaching the deflector body to an orienting and locking device to releasably install the whipstock at a selected downhole location.

In another embodiment, a first fishing neck profile may be provided within the longitudinal passageway to provide means for releasably coupling the deflector body with the running tool for installing the tubing exit whipstock at a selected downhole location within the first wellbore.

In yet another embodiment, the fishing neck may provide means for releasably coupling the deflector body with a pulling tool for removing the tubing exit whipstock from the selected downhole location within the first wellbore.

In a further embodiment, the deflector body may include a generally cylindrical hollow core disposed within the deflector body. A mechanical connector capable of releasably coupling the hollow core within the deflector body may also be provided. In one embodiment, a fishing neck is provided within the hollow core for connection to a downhole tool. In another embodiment, a second fishing neck is provided within the longitudinal passageway of the deflector body for connection to a larger diameter downhole tool. In one embodiment, the mechanical connector may provide means for releasing the hollow core from within the deflector body when a predetermined amount of force is applied thereto.

Technical benefits of the present invention include providing a tubing exit whipstock with a configuration that will allow larger diameter downhole tools to pass from the main wellbore into a lateral wellbore. By providing the fishing neck profile within the deflector body of the whipstock, rather than at an uphole location, downhole tools will not have to pass through the fishing neck profile in order to gain access to the lateral wellbore.

Another technical advantage of the present invention includes providing a tubing exit whipstock that can be removed from a wellbore in sections. When a tubing exit whipstock becomes stuck within the wellbore, the inner core will be released from the deflector body and removed from the wellbore independently of the remaining components of the whipstock. By removing the inner core from the deflector body, a second fishing neck profile is exposed within the longitudinal passageway of the deflector body which will accommodate a larger diameter downhole tool for the removal of remaining components of the whipstock.

BRIEF DESCRIPTION OF THE DRAWINGS

For a more complete understanding of the present invention and its advantages, reference is now made to the following brief description, taken in conjunction with the accompanying drawings and detailed description, wherein like reference numerals represent like parts, in which.

DETAILED DESCRIPTION OF THE INVENTION

The preferred embodiments of the present invention and its advantages are best understood by referring now in more detail to FIGS. 1–9C of the drawings, in which like numerals refer to like parts.

Figure 1:
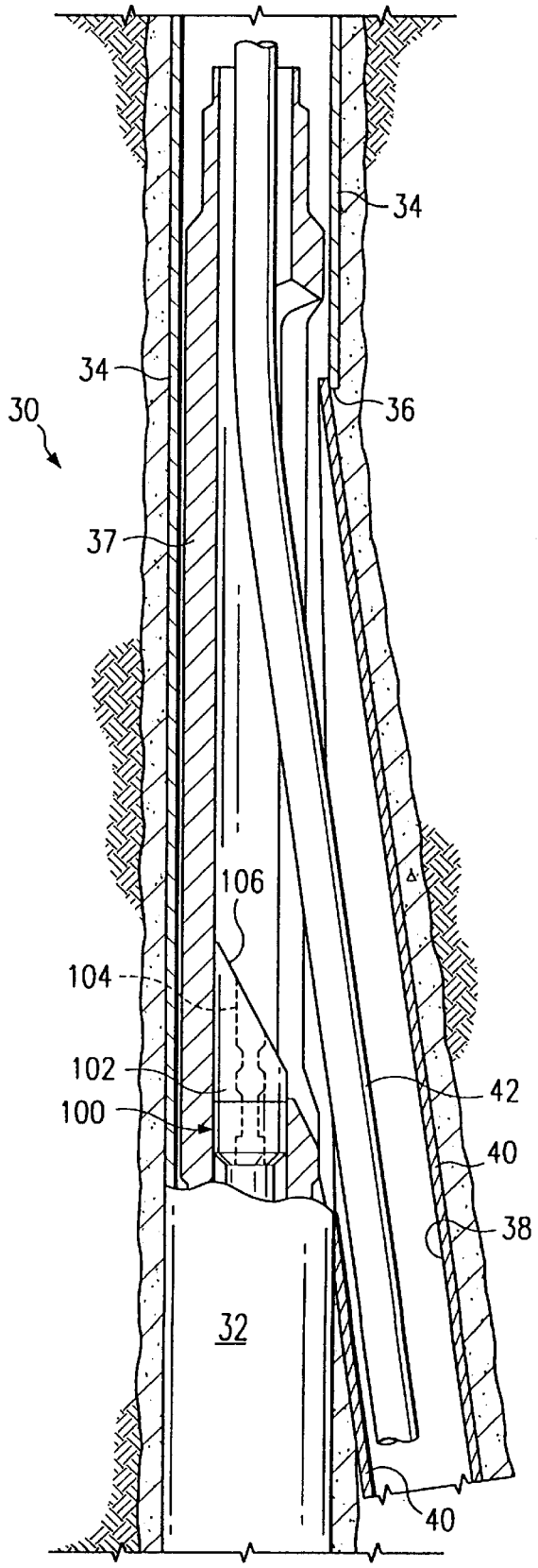
FIG. 1 is a schematic drawing in section and in elevation showing a typical well completion having a first wellbore with a second wellbore extending therefrom and downhole equipment incorporating teachings of the present invention.

Referring to FIG. 1, a diagrammatic cutaway side view of a well 30 is illustrated. Well 30 may be used for production of hydrocarbons, but the present invention is also suitable for use with other types of wells.

Well 30 includes a first wellbore 32 having a casing 34 cemented therein. Casing 34 has an opening 36 milled in one side thereof at a location spaced above the lower end of casing 34. A lateral re-entry system (LRS) window 37 is preferrably installed within casing 34 adjacent to opening 36. Well 30 also includes a lateral wellbore 38 having a liner 40 cemented therein. Liner 40 communicates with casing 34 through opening 36 and LRS window 37.

A tubing exit whipstock 100 may be releasably installed within LRS window 37 adjacent to opening 36. Tubing exit whipstock 100 includes a generally cylindrical deflector body 102 with longitudinal passageway 104 extending therethrough. Tapered surface 106 of deflector body 102 forms a ramplike structure used to deflect coil tubing 42 and other downhole tools (not expressly shown) through LRS window 37 and into lateral wellbore 38.

Figure 2:
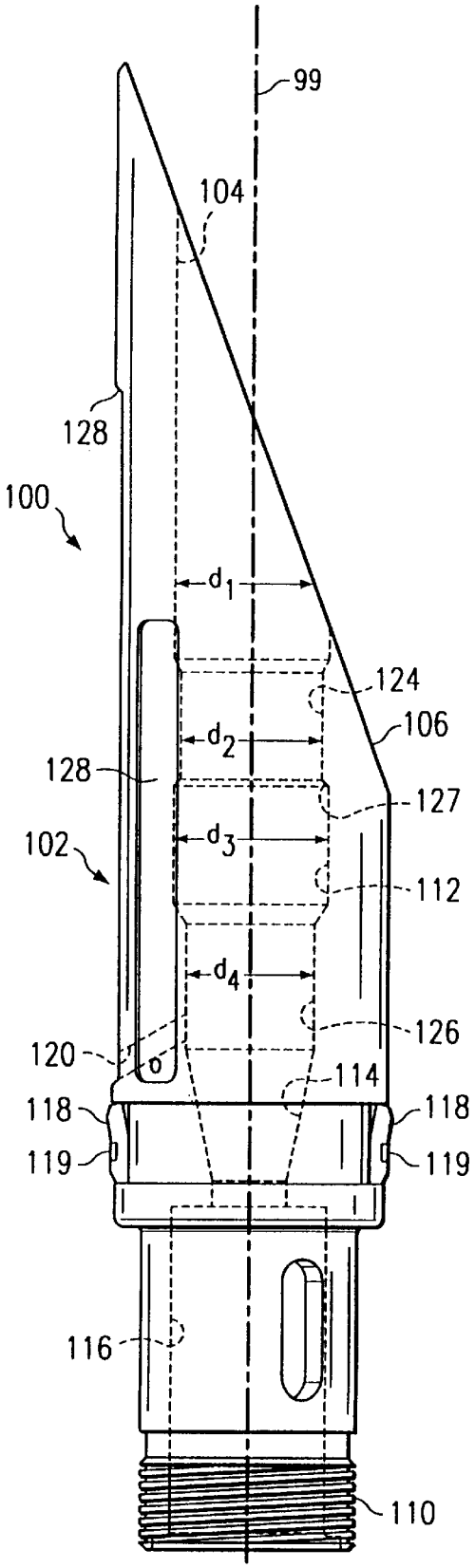
FIG. 2 is a schematic drawing in elevation showing a side view of a tubing exit whipstock suitable for use within the well completion of FIG. 1.
Figure 3:
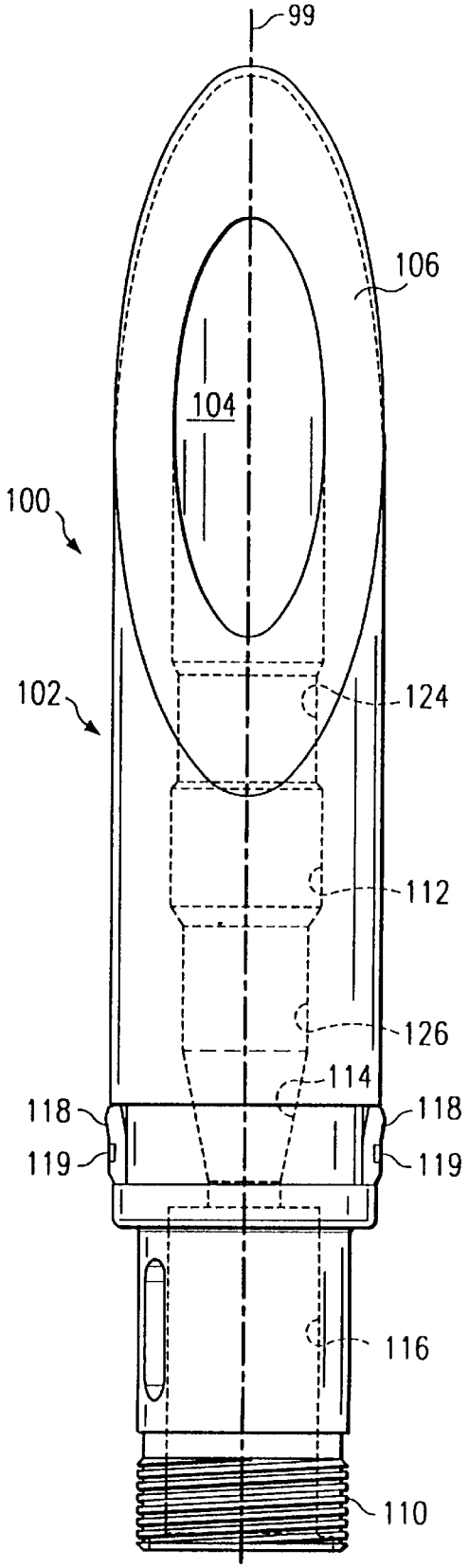
FIG. 3 is a schematic drawing in elevation showing another side view of the tubing exit whipstock of FIG. 2.

Referring now to FIGS. 2 and 3, diagrammatic side views of tubing exit whipstock 100 are illustrated. Longitudinal passageway 104 extends completely through deflector body 102 of tubing exit whipstock 100 to allow communication of fluid through whipstock 100. Tubing exit whipstock 100 and longitudinal passageway 104 share a common longitudinal axis 99.

As illustrated in FIGS. 2 and 3, the diameter of longitudinal passageway 104 varies throughout, from tapered surface 106 to threaded connection 110. The diameter $d_1$ of longitudinal passageway 104 at tapered surface 106 is depicted in FIG. 2. The size of diameter $d_1$ is selected to ensure that downhole tools intended to be deflected into wellbore 38 does not enter longitudinal passageway 104. When tools with a larger diameter than $d_1$ are deployed within first wellbore 32, diameter $d_1$ and tapered surface 106 cooperate to guide the equipment into the lateral wellbore.

The diameter of longitudinal passageway 104 is reduced to $d_2$ at collar 124. The reduced diameter $d_2$ of collar 124 cooperates with fishing neck 112, and its associated enlarged diameter $d_3$ to form a circumferential shoulder 127 within longitudinal passageway 104. Circumferential shoulder 127 is provided to allow for the mechanical coupling of downhole tools with whipstock 100, which will be described in more detail later. The downhole tools accommodates the installation and retrieval of whipstock 100 to and from LRS window 37.

Fishing neck 112 contains a grooved profile which can be coupled with mechanical connectors provided by various downhole tools during installation and/or retrieval of whipstock 100. In one embodiment of the present invention, the mechanical connector associated with the downhole tools may include a collet type connector, as is commonly known in the art. When a collet connector or similar connection is established with fishing neck 112, shoulder 127 provides a surface which prevents the collet from being removed from longitudinal passageway 104 and helps secure the downhole tool firmly in place. Downhole tools appropriate for use with whipstock 100 will be discussed later in more detail.

Figure 7:
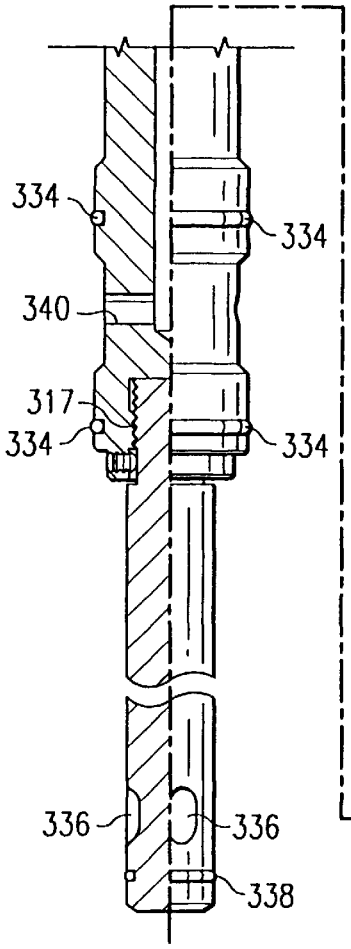
FIG. 7 is a schematic drawing in section and in elevation with portions broken away illustrating a running tool suitable for use with the tubing exit whipstocks of FIGS. 2–6.
Figure 7:
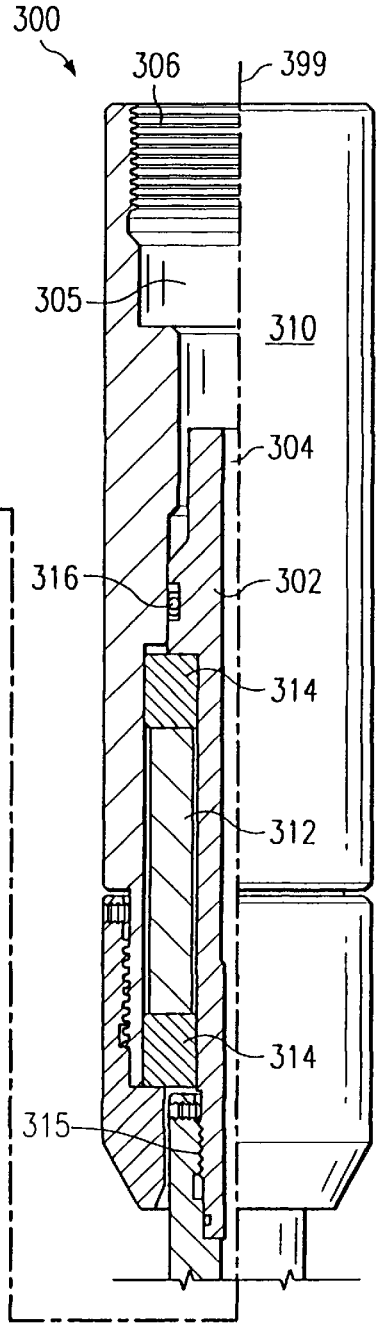
Figure 8:
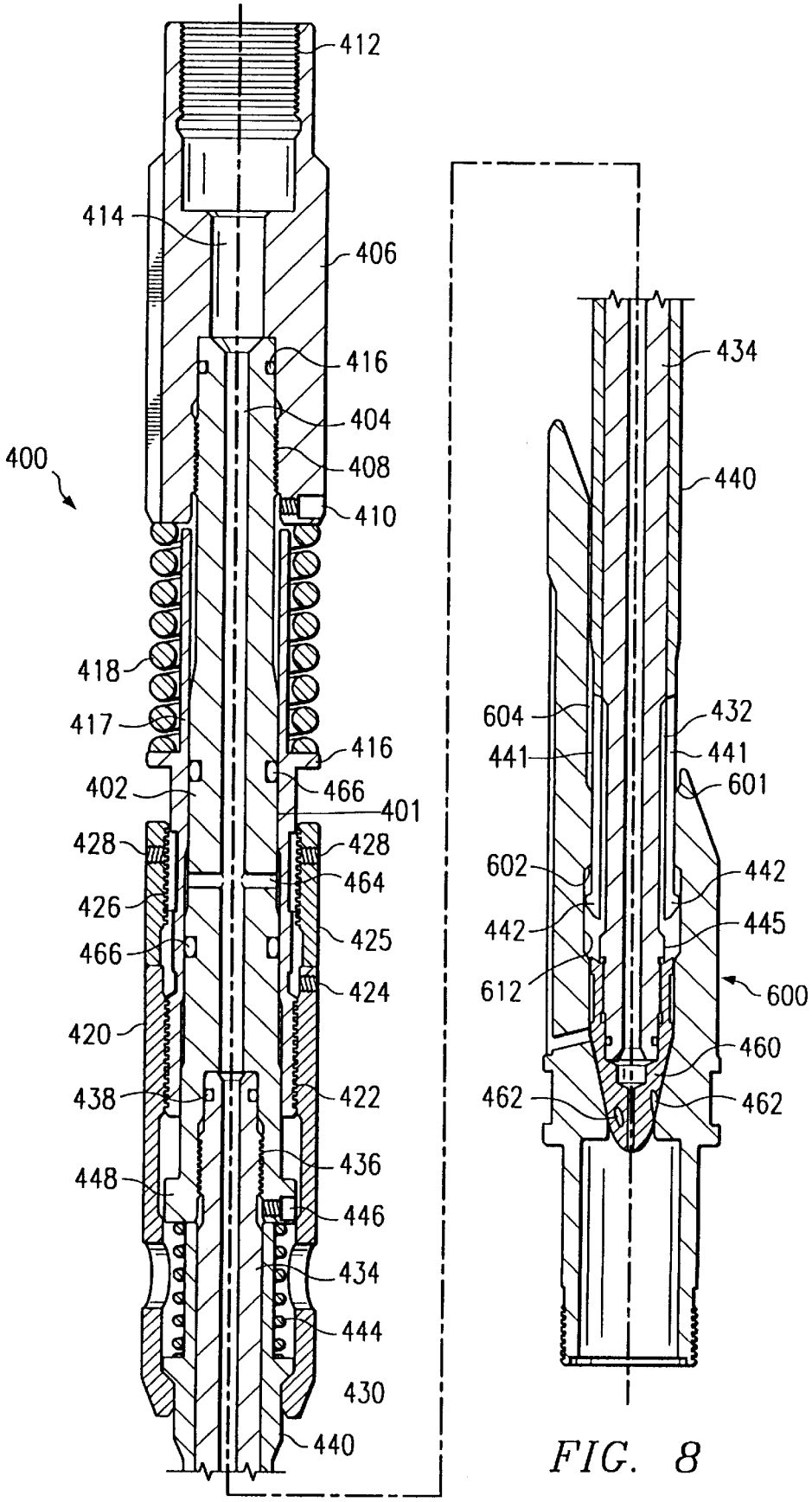
FIG. 8 is a schematic drawing in section with portions broken away illustrating a pulling tool suitable for use in the retrieval of the tubing exit whipstocks of FIGS. 2–6.

The diameter of longitudinal passageway 104 is further reduced at a second collar 126. The diameter $d_4$ of second collar 126 and the diameter $d_2$ of first collar 124 are selected to cooperate with a particular running tool which will be described later in more detail. Longitudinal passageway 104 also includes nozzle profile 114 which is tapered toward the longitudinal axis 99 of longitudinal passageway 104 from second collar 126 to fluid port 116. Nozzle profile 114 is also configured to match a corresponding nozzle profile of a downhole tool. Portion 116 of longitudinal passageway 104 communicates fluid to and from other equipment (not expressly shown) coupled with whipstock 100. FIGS. 7–9 illustrate downhole tools suitable for use with whipstock 100, within the teachings of the present invention.

In one embodiment of the present invention, a debris barrier 118 is installed around the outer diameter of deflector body 102. Debris barrier 118 prevents debris and sediment located above tubing exit whipstock 100 from passing between deflector body 102 and the inside diameter of window 37, to a location below debris barrier 118. In the disclosed embodiment, debris barrier 118 comprises an elastomeric material, but it will be obvious to one skilled in the art that debris barrier 118 may be fabricated from various different materials, including plastics.

In the disclosed embodiment, a metal ring 119 surrounds debris barrier 118 to hold debris barrier 118 firmly in place upon deflector body 102. The diameter of metal ring 119 is slightly larger than the diameter of deflector body 102 at the location on deflector body 102 where metal ring 119 is installed. Accordingly, debris barrier 118 is compressed against deflector body 102 at the interface between metal ring 119 and deflector body 102.

In another embodiment, debris barrier 118 may be installed upon deflector body 102 in an angled manner such that the distance between tapered surface 106 and debris barrier 118 is constant, thereby increasing the area of debris barrier 118 and improving its ability to prevent debris from passing deflector body 102.

While tubing exit whipstock 100 is installed within LRS window 37, it is common for debris and sediment (not shown) to collect and accumulate between deflector body 102 and LRS window 37. This is frequently caused by pumping operations or other activities occurring within lateral and/or vertical wellbores at a location above tubing exit whipstock 100. This can complicate the retrieval of tubing exit whipstock 100 and increase the amount of force required to retrieve tubing exit whipstock 100 from within LRS window 37. In order to accommodate the removal of the debris and sediment between deflector body 102 and LRS window 37 a fluid passageway 120 is preferrably provided between longitudinal passageway 104 and the exterior of deflector body 102. As fluid is pumped from a downhole tool (not expressly shown) through longitudinal passageway 104, pressure will develop within longitudinal passageway 104 forcing fluid through fluid passageway 120. This fluid will be prevented from traveling downhole by debris barrier 118 and fluid pressure will force the fluid upward. The upward flow of fluid will dislodge debris and sediment from the exterior of deflector body 102.

In order to enhance the flow of fluid through passageway 120 around the diameter of deflector body 102, fluid flow channels 128 are preferrably provided in the exterior of deflector body 102. Fluid traveling through fluid passageway 120 upward along fluid channels 128, forces debris between deflector body 102 and LRS window 37 to a position above tubing exit whipstock 100. Within the teachings of the present invention, one or more fluid channels may be provided of various sizes and configurations to accommodate the most efficient flow of fluid from longitudinal passageway 104, along the outer diameter of deflector body 102, to a location above whipstock 100.

In the disclosed embodiment, fluid channels 128 have a generally semi-circular cross section of generally uniform radius, and run parallel to the longitudinal axis of longitudinal passageway 104. It will be obvious to one skilled in the art that the number, configuration and profile of fluid channels can be altered within the teachings of the present invention.

As shown in FIGS. 2–4B, threaded connection 110 is provided on deflector body 102 to allow coupling of tubing exit whipstock 100 with orienting and locking device 150 that will ultimately be located downhole from tubing exit whipstock 100, when whipstock 100 is installed within LRS window 37. Whipstock 100 is rotationally fixed with respect to orienting and locking device 150. Orienting and locking device 150 includes an elongated mandrel 152 with a longitudinal passageway 154 extending therethrough. Orienting and locking device 150 and longitudinal passageway 154 have a longitudinal axis 99 in common with deflector body 102 and longitudinal passageway 104. A cylindrical housing 156 is slidably coupled with mandrel 152. Housing 156 includes a plurality of selective keys 160 which are configured to cooperate with a selective profile contained within LRS window 37. As cylindrical housing 156 is deployed downhole, selective keys 160 spring outward and cooperate with the selective profile of LRS window 37 to set housing 156 at the proper elevation within wellbore 32. Selective keys 160 also prevent tubing exit whipstock 100 from moving downhole after tubing exit whipstock 100 is landed within LRS window 37.

A second cylindrical housing 164 is provided at the downhole end of mandrel 152. Alignment key 140 is provided upon cylindrical housing 164. Alignment key 140 cooperates with a second grooved profile (not shown) contained within LRS window 37 to rotationally align whipstock 100 within LRS window 37. Alignment key 140 forces the rotation of housing 164, mandrel 152 and whipstock 100 with respect to housing 156 until the appropriate preselected rotational orientation of whipstock 100 is achieved, aligning tapered surface 106 with opening 36.

Housing 164 is fixedly coupled to mandrel 152, and includes a collet connector 166. Collet connector 166 includes collet fingers 168 which cooperate with a third grooved profile (not shown) contained within LRS window 37 to releasably install orienting and locking device 150 within LRS window 37.

Figure 4A:
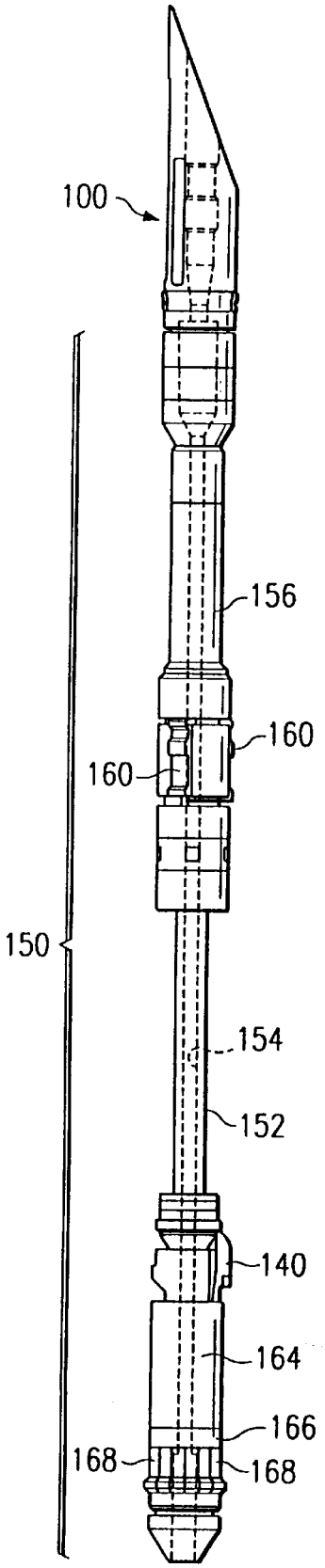
FIG. 4A is a schematic drawing in section and in elevation showing the whipstock of FIGS. 2 and 3 coupled with an orienting and locking device in a first position suitable for use within the teachings of the present invention.
Figure 4B:
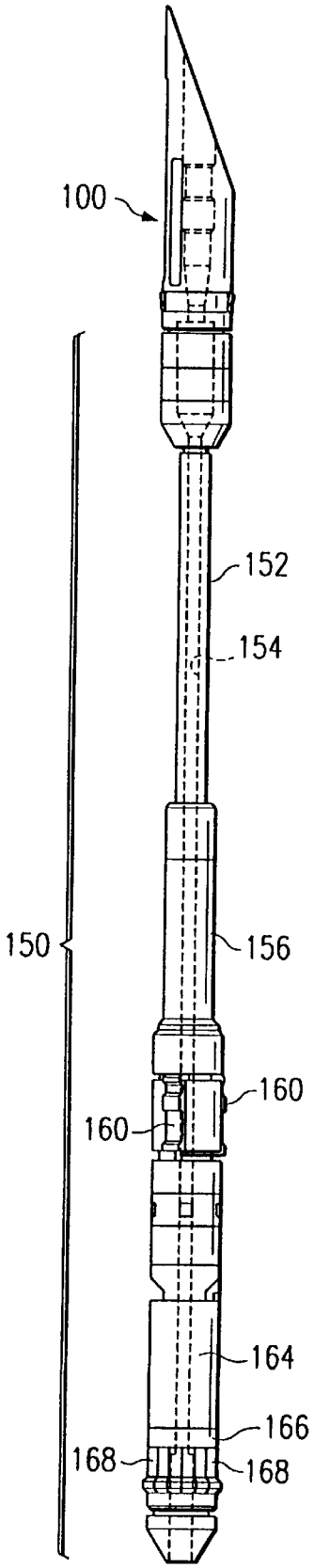
FIG. 4B is a schematic drawing in section and in elevation showing the whipstock of FIGS. 2 & 3 along with the orienting and locking device of FIG. 4A in a second position.

FIG. 4B illustrates whipstock 100 coupled with orienting and locking device 150 in a first "running" position. While orienting and locking device 150 is deployed within a wellbore 32, the running position will be maintained. When orienting and locking device 150 enters LRS window 37, selective keys 160 cooperate with the first grooved profile of LRS window 37 to prevent further downward movement of housing 156. Additional downward force imposed upon whipstock 100 will cause the separation of housing 156 and housing 164, which releases alignment key 140. Alignment key 140 further cooperates with the second grooved profile to rotationally align whipstock 100 with LRS window 37.

FIG. 4A depicts the position of orienting and locking device 150 in a second "set" position wherein the elevation and orientation of whipstock 100, with respect to LRS window 37, allow for the effective communication of downhole tools through opening 36. An orienting and locking device suitable for use within the teachings of the present invention is available from Dresser Oil Tools, a division of Dresser Industries, Inc., Dallas, Tex. (See part no. 445-S-0018).

Figure 5:
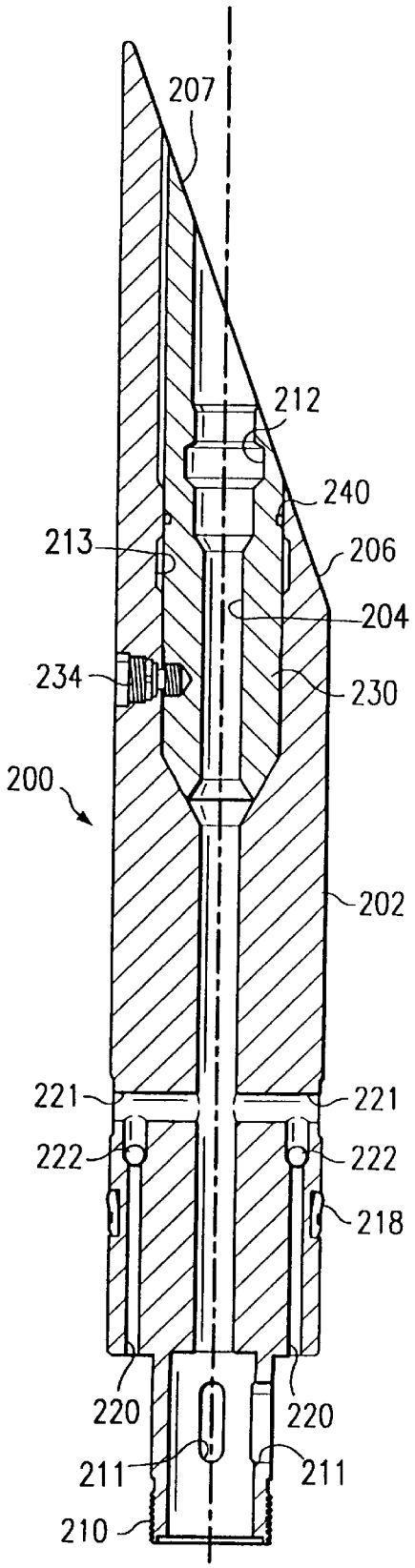
FIG. 5 is a schematic drawing in section with portions broken away showing another embodiment of the tubing exit whipstock of FIGS. 2 and 3.

Referring now to FIG. 5, an alternative embodiment of the tubing exit whipstock of FIGS. 1–3 is illustrated. Tubing exit whipstock 200 may be utilized within LRS window 37 interchangeably with whipstock 100 of FIGS. 1–3. Whipstock 200 includes a deflector body 202 and an inner core 230. A longitudinal passageway 204 extends completely through inner core 230 and deflector body 202 to allow for communication of fluid through whipstock 200. Deflector body 202 has a tapered surface 206, and inner core 230 has a tapered surface 207, which cooperate to form a ramplike structure used to deflect coil tubing 42 and downhole tools (not expressly shown) through LRS window 37 and into lateral wellbore 38 of FIG. 1.

In the disclosed embodiment, inner core 230 is releasably coupled to deflector body 202 with one or more shear pins 234. Shear pins 234 may be provided such that a predetermined force imposed upon shear pins 234 will release inner core 230 from deflector body 202. Inner core 230 can then be slidably removed from within deflector body 202.

A first fishing neck 212 is provided by inner core 230 within longitudinal passageway 204. The diameter of first fishing neck 212 includes a grooved profile to allow a releasable coupling between inner core 230 and various downhole tools which will be described in more detail later, for the installation and retrieval of tubing exit whipstock 200 from within LRS window 37 and casing 34.

A debris barrier 218 is provided around the outer diameter of deflector body 202 to prevent debris and sediment (not shown) located above debris barrier 218 from passing between deflector body 202 and window 37 to a downhole location. A metal ring 219 secures debris barrier 218 in place upon deflector body 202.

Since debris barrier 218 fills the void between deflector body 202 and window 37, debris barrier 218 will also restrict communication of fluid along the outer diameter of deflector body 202, between deflector body 202 and window 37. During the installation of whipstock 200 within window 37, it may be desirable to allow fluid contained within wellbore 32 and window 37 to pass through deflector body 202. Accordingly, fluid passageways 220 may be provided within deflector body 202. Fluid passageways 220 provide conduits for the communication of fluid located within casing 34 and window 37, downhole from debris barrier 218 to a horizontal fluid passageway 221. Fluid may then be communicated between horizontal fluid passageway 221 and longitudinal passageway 204.

Fluid may also be communicated between horizontal fluid passageway 221 and the perimeter of deflector body 202, between whipstock 200 and LRS window 37, at a location above debris barrier 218. Fluid traveling in this latter path, will also help wash away any debris or sediment which may collect along the outer diameter of whipstock 200 while it is disposed within first wellbore 32 and window 37. By allowing fluid to pass through deflector body 202, the amount of fluid pressure exerted upon tubing exit whipstock 200 while it is traveling downhole, is substantially reduced.

Check valves 222 may be installed within fluid passageways 220 to control the direction of flow of fluid through fluid passageways 220. In the disclosed embodiment, two check valves 222 are provided which allow the communication of fluid from a location downhole of debris barrier 218 into longitudinal passageway 204. Conversely, check valves 222 will prevent the communication of fluid from longitudinal passageway 204 to a location within casing 34 downhole from debris barrier 218.

A threaded connection 210 is provided on deflector body 202 to allow for the coupling of tubing exit whipstock 200 with an orienting and locking device (not shown) similar to the device illustrated in FIGS. 4A and 4B. Slotted opening 211 and threaded connection 210 cooperate with the orienting and locking device to releasably couple tubing exit whipstock 200 with the orienting and locking device prior to installing tubing exit whipstock 200 and the orienting and locking device into LRS window 37, at a preselected downhole location.

The diameter and therefore the strength of the tools utilized to remove whipstock 200 from within LRS window 37 is limited by the diameter of longitudinal passageway 204. Accordingly, in the event that whipstock 200 becomes wedged within window 37 or wellbore 32, the amount of force which can be exerted on a pulling tool coupled with first fishing neck 212 is limited. When the amount of force sufficient to dislodge whipstock 200 from casing 34 is greater than the force which can be exerted on a pulling tool coupled with fishing neck 212, an alternative method of dislodging tubing exit whipstock 200 from casing 34 is provided by the configuration of tubing exit whipstock 200.

Shear pins 234 may be provided such that they will not fracture when the amount of force typically required to remove tubing exit whipstock 200 is exerted upon a pulling tool coupled with first fishing neck 212. Furthermore, shear pins 234 may be provided such that they will fracture at a force less than the expected failure load of the pulling tool coupled with first fishing neck 212. By providing shear pins meeting this criteria, a retrieval tool coupled with inner core 230 will remove the entire whipstock 200 from the LRS window 37 and casing 34, under normal operating conditions. If whipstock 200 becomes wedged within LRS window 37 or other portion of first wellbore 32, and requires more force than the retrieval tool is capable of sustaining, the well operator has the option of applying enough force on the retrieval tool to fracture shear pins 234. When shear pins 234 are fractured, inner core 230 is released from deflector body 202. Inner core 230 is then free to be removed from LRS window 37 and casing 34 with the retrieval tool, leaving the remaining components of whipstock 200 behind.

Although the disclosed embodiment utilizes shear screws 234 to achieve the releasable coupling of inner core 230 with deflector body 202, it will be obvious to those skilled in the art that many types of releasable mechanical connectors are suitable for use within the teachings of the present invention. For example, a collet with a shearable support sleeve may be utilized in lieu of shear screws.

Deflector body 202 is provided with a second fishing neck 213 to accommodate a larger diameter pulling tool being coupled with deflector body 202. Second fishing neck 213 is provided with a larger diameter grooved profile than first fishing neck 212. Accordingly, a larger diameter pulling tool can be utilized and a greater amount of force can be imposed upon the pulling tool coupled with second fishing neck 213. In most instances, the additional force imposed upon the pulling tool will be sufficient to dislodge the remaining components of whipstock 200 from LRS window 37 and casing 34.

A seal ring 240 may be provided at the outer diameter of inner core 230 to provide a barrier between inner core 230 and deflector body 202. Seal ring 240 prevents debris from passing between inner core 230 and deflector body 202, which can interfere with the operation of second fishing neck 213 and prevent inner core 230 from being slidably removed from deflector body 202.

Figure 6:
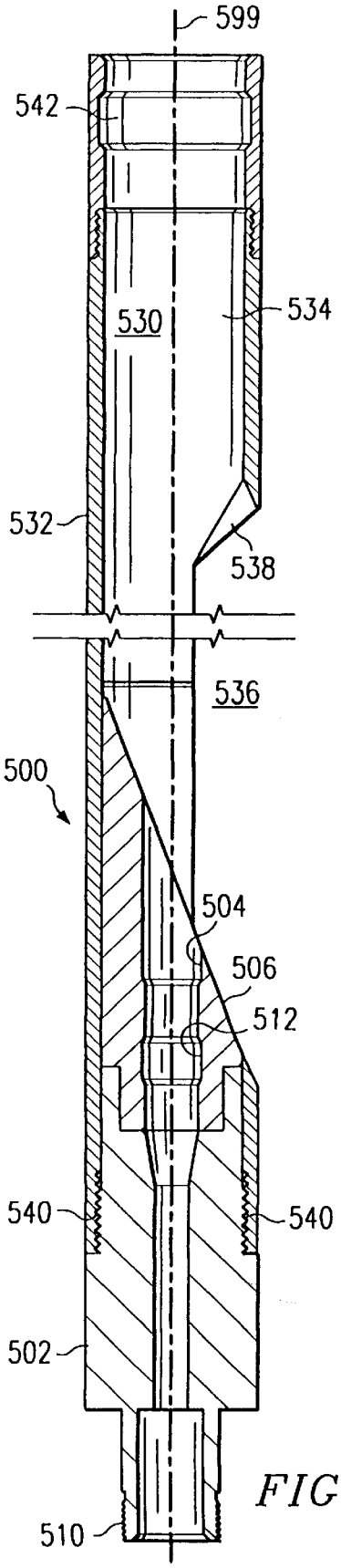
FIG. 6 is a schematic drawing in section, with portions broken away, showing another embodiment of the tubing exit whipstock of FIGS. 2 and 3.

Referring now to FIG. 6, a tubing exit whipstock 500 suitable for use within teachings of the present invention is illustrated. Tubing exit whipstock 500 includes a generally cylindrical deflector body 502 with a longitudinal passageway 504 extending therethrough. Deflector body 502 and longitudinal passageway 504 share a common longitudinal axis 599. Tapered surface 506 forms a ramp-like structure for deflecting downhole tools (not shown) as they encounter whipstock 500 at a downhole location within a wellbore (not shown).

A cylindrical fishing neck 512 with an internal grooved profile is contained within longitudinal passageway 504. The grooved profile of fishing neck 512 is configured to cooperate with a mechanical connector of a downhole tool (not shown) during the installation and retrieval of whipstock 500 within the wellbore.

Deflector body 502 includes a threaded connection 510 at one end on which an orienting and locking device (not shown) is releasably attached. The orienting and locking device is utilized to releasably install tubing exit whipstock 500 at a pre-selected location within a wellbore.

An elongated mandrel 530 is releasably attached to deflector body 502 at threaded connection 540. Elongated mandrel 530 includes a generally cylindrical body 532 with a longitudinal bore 534 extending therethrough. Cylindrical body 532 has an opening 536 milled in one side thereof, at a location adjacent to tapered surface 506. Opening 536 cooperates with tapered surface 506 to allow the downhole tools to be deflected toward a selected downhole location within the wellbore. Opening 536 includes a tapered shoulder 538 milled thereon. Tapered shoulder 538 provides a smooth transition for a tubing string (not shown) and the downhole tools as they are retrieved through opening 536.

A fishing neck 542 is contained within cylindrical body 532 at the upper end thereof. Fishing neck 542 includes a grooved profile which cooperates with selected downhole tools to form a releasable mechanical coupling. The downhole tools may be utilized for the installation and retrieval of whipstock 500.

Elongated mandrel 530 provides a well operator with an option for installing and retrieving whipstock 500 from within the wellbore. Prior to installing whipstock 500 within the wellbore, elongated mandrel 530 may be removed from deflector body 502. When mandrel 530 is removed from deflector body 502, fishing neck 512 can be coupled with selected downhole tools for the installation and retrieval of whipstock 500. In the alternative, elongated mandrel 532 can remain coupled to deflector body 502 during installation and retrieval of whipstock 500. With elongated mandrel 532 attached to deflector body 502, fishing neck 542 can be coupled with downhole installation and retrieval tools.

Referring now to FIG. 7, a running tool of the type capable of setting whipstock 100 within LRS window 37 is illustrated. Running tool 300 is utilized for releasably installing tubing exit whipstock 100 at a selected downhole location within LRS window 37. Running tool 300 includes an elongated mandrel 302 having a generally cylindrical configuration with a longitudinal bore 304, sharing a longitudinal axis 399 with mandrel 302, extending therethrough. Elongated mandrel 302 includes three separate parts connected with threaded fittings 315 and 317.

Elongated mandrel 302 is rotationally disposed within a housing assembly 310. Housing assembly 310 also includes a longitudinal bore 305 which encompasses mandrel 302, and allows for the communication of fluid from the tubing string, through the housing assembly 310 and into longitudinal bore 304.

Bushings 314 are provided at the interface between mandrel 302 and cylindrical housing 310 flush with the surfaces of mandrel 302 and cylindrical housing 310. A rectangular spacer 312 is provided between bushings 314 to secure bushings 314 in place. Bushings 314 cooperate with spacer 312 to allow for the axial rotation of cylindrical housing 310 with respect to mandrel 302. A seal ring 316 is provided between mandrel 302 and cylindrical housing 310. Seal ring 316 prevents fluid pressure contained within longitudinal bore 305 from escaping through the space between mandrel 302 and cylindrical housing 310.

Three ball bearing recesses 336 are formed upon the mandrel 302 of running tool 300. Ball bearing recesses 336 cooperate with three ball bearings (not shown) to form a releasable coupling between running tool 300 and the whipstock. The ball bearings within the whipstock are configured to allow running tool 300 to be installed upon and removed from the whipstock with the application of the predetermined amount of force.

Running tool 300 is configured to cooperate with a whipstock of the type shown in FIGS. 4A and 4B to form a releasable coupling with whipstock 100. Running tool 300 is installed within whipstock 100 by inserting mandrel 302 within the longitudinal bore 104 of whipstock 100. Ball bearing recesses 336 will cooperate with ball bearings (not expressly shown) contained within the orientating and locking device 150 to form an releasable coupling between whipstock 100 and running tool 300. Seal ring 338 will contact the inner diameter of longitudinal bore 154 to form a barrier between the inner diameter of longitudinal bore 154 and mandrel 302.

Seal rings 334 will contact the inner diameters of collars 124 and 126 to form a pressure seal between whipstock 100 and running tool 300. This feature allows an operator to determine when the running tool has been separated from the whipstock 100 at a downhole location. By applying pressure to the tubing string, through longitudinal bore 305 and longitudinal bore 304, fluid pressure will be prevented from escaping from port 340 when whipstock 100 and running tool 300 are coupled together. When enough upward force is applied to break the connection between ball bearing recesses 336 and the ball bearings within orientating and locking device 150, port 340 will slide upward relative to whipstock 100. Once port 340 has cleared the reduced diameters of collars 124 and 126, pressure will escape into the wellbore. A drop in pressure at the well surface will indicate that pulling tool 300 has been successfully decoupled from whipstock 100.

Mandrel 302 includes a threaded connection 306 at one end of running tool 300. Threaded connection 306 allows running tool 300 to be coupled to a tubing string (not explicitly shown) which allows running tool 300 to be deployed within and retrieved from casing 34.

Referring now to FIG. 8, a pulling tool of the type capable of removing whipstock 100 from within LRS window 37 is illustrated. Pulling tool 400 comprises an elongated mandrel assembly 402 having a generally cylindrical configuration with a longitudinal bore 404 extending therethrough. A cylindrical adapter 406 is provided at one end of mandrel assembly 402 for mechanically connecting pulling tool 400 with a tubing string (not explicitly shown). Adapter 406 is coupled with mandrel assembly 402 at threaded connection 408. A set screw 410 is provided within adapter 406 to prevent the rotation of adapter 406 with respect to mandrel assembly 402. Adapter 406 is mechanically coupled to a tubing string (not explicitly shown) at threaded connection 412. A longitudinal bore 414 extending through adapter 406 connects with longitudinal bore 404 for the communication of fluid through adapter 406 and mandrel assembly 402 to a downhole location. A seal ring 416 is provided at the interface between adapter 406 and mandrel assembly 402 surrounding the entire diameter of mandrel assembly 402 to prevent a loss of pressure within longitudinal bores 414 and 404 by allowing fluid to escape from the connection between adapter 406 and mandrel assembly 402. A housing assembly 420 is disposed around the exterior of mandrel assembly 402. Housing assembly 420 is secured to a piston 417 at threaded connection 422. Set screw 424 prevents the rotation of housing assembly 420 with respect to piston 417 when such rotation is not desired. Collar 425 is secured to piston 417 at threaded connection 426. Collar 425 is prevented from rotating with respect to piston 417 by set screws 428 when such rotation is not desired. Collar 425 provides additional support for the securing of housing assembly 420 with respect to piston. Housing assembly 420 secures collet 440 with associated collet fingers 441 and collet heads 442 against elongated mandrel assembly 402. A collet spring 444 is compressed by collet 440. Mandrel assembly also includes a reduced diameter neck 432 which allows collet heads 442 and collet fingers 441 to be displaced radially inward. Elongated mandrel assembly 402 also includes support diameter 445, which supports collet heads 442 as described more fully below.

An upper mandrel 401 of mandrel assembly 402 is mechanically coupled with a reduced diameter mandrel 434 at threaded connection 436 and seal ring 438 is provided between reduced diameter mandrel 434 and mandrel 401 to prevent a loss of pressure from longitudinal bore 404 through the connection between reduced diameter mandrel 434 and mandrel 401. A set screw 446 is provided in mandrel 401 to prevent the rotation of mandrel 401 with respect to reduced diameter mandrel 434. Mandrel 401 also includes shoulder 448 which provides an interface between mandrel 401 and collet spring 444. A nose assembly 460 is attached to elongated mandrel assembly 402. Nose assembly 460 includes fluid jet ports 462 which communicate fluid between longitudinal bore 404 and whipstock 600.

As illustrated in FIGS. 8 and 9A–C, in order to retrieve a tubing exit whipstock 600 within the LRS window 37 of a multilateral well 30, pulling tool 400 is coupled with a tubing string (not explicitly shown) at threaded connection 412. Pulling tool 400 is then inserted into the LRS window 37 until it contacts a whipstock 600. In the running position collet spring 444 is in its most outstretched position forcing collet heads 442 to contact support diameter 445.

Figure 9A:
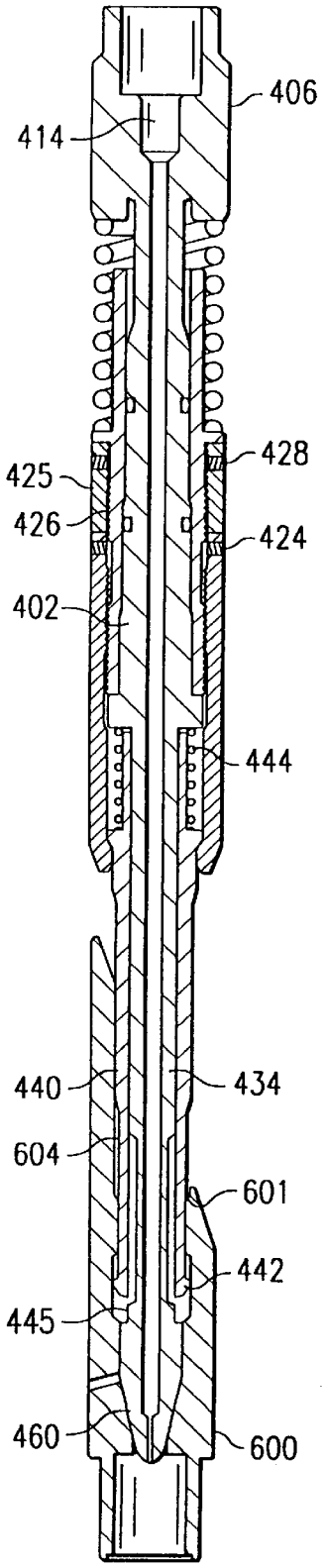
FIGS. 9A–9C are schematic drawings in section with portions broken away illustrating relative movement of various components associated with the pulling tool of FIG. 8, as the pulling tool engages and prepares for retrieval of a tubing exit whipstock incorporating teachings of the present invention.
Figure 9B:
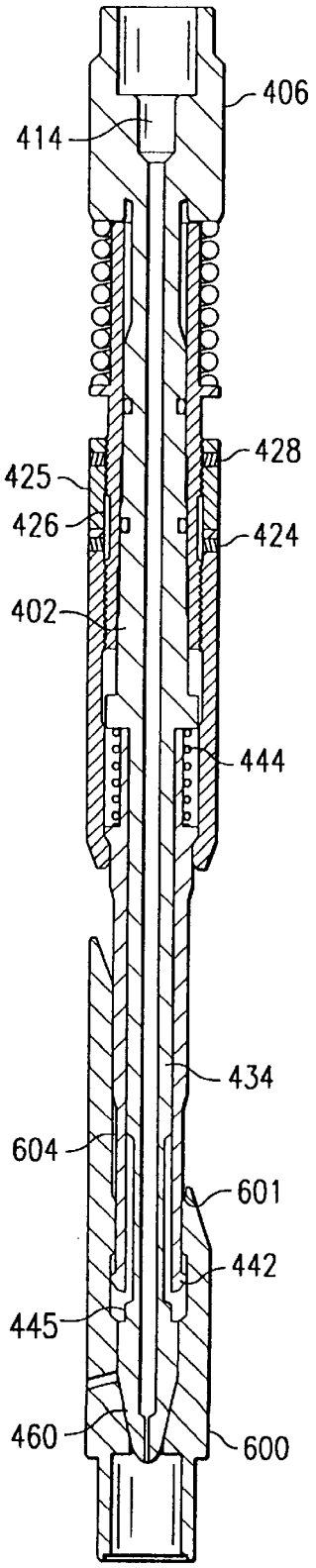
Figure 9C:
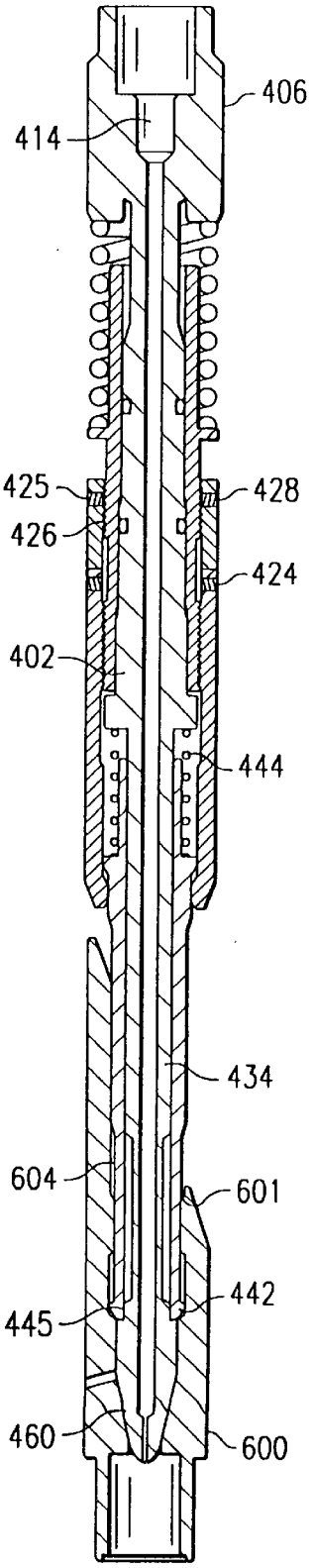

As the nose assembly 460 enters the longitudinal bore 604 of whipstock 600, collet heads 442 contact whipstock shoulder 601. Since support diameter 445 prevents collet heads 442 from flexing inward to allow collet heads 442 to pass whipstock shoulder 601 collet heads 442 exert a force on collet fingers 441 which is transferred to collet spring 444 forcing collet fingers 441 inward toward mandrel 434. As collet heads 442 are drawn inward toward the reduced diameter 432 of mandrel 434 collet heads 442 retract into reduced diameter 432 allowing the collet heads 442 and collet fingers 441 to pass the shoulder 601 of whipstock 600. Once the collet heads enter the increased diameter of fishing neck 612 the collet fingers 441 and collet heads 442 expand outward and are forced forward toward support diameter 445 by collet spring 444. The running position and first landed position of pulling tool 400 is depicted in FIG. 9C.

Once the collet heads 442 are secured in this position, whipstock 600 is ready for retrieval. The tubing string (not shown) is now pulled out of well 30. As the retrieval tool is pulled upwards with respect to whipstock 600 collet heads 442 contact whipstock shoulder 602. The support diameter 445 prevents collet heads 442 from retracting inward. At this point retrieving tool 400 is releasably mechanically coupled to whipstock 600. Upward force on tubing string (not shown) is transferred to pulling tool 400 which is coupled to whipstock 600 and the system comprising pulling tool 400 and whipstock 600 is removed from the well.

Once the pulling tool 400 and whipstock 600 have been removed from the well tubing exit whipstock 600 must be removed from pulling tool 400. In order to accomplish this set screws 428 must be released and collar 425 must be rotated relative to mandrel 401 such that collar 425 is drawn away from housing assembly 420. Collar 425 can be rotated until contact with shoulder 416 is established. Next, set screw 424 is loosened which allows housing assembly 420 to be rotated with respect to the mandrel 402. As housing assembly 420 is drawn backward toward collar 425, the shoulder 430 of housing assembly 420 contacts collet 440. Collet spring 444 is then compressed allowing collet 440 to be drawn away from support diameter 445 allowing collet heads 442 to retract into recess 432 which will free whipstock 600 from pulling tool 400. This "manual release" position is illustrated in FIG. 9A.

Another method of decoupling pulling tool 400 from whipstock 600 is provided by the configuration of pulling tool 400. While whipstock 600 and pulling tool 400 are coupled at a downhole location during the retrieval process pulling tool 400 can be decoupled from whipstock 600 with a hydraulic release mechanism. Fluid is pumped through the tubing string and into bare 414 and longitudinal passageway 404 causing an increase of fluid pressure within longitudinal passageway 404. Fluid passageways 464 are provided to allow fluid pressure to escape longitudinal passageway 404 creating pressure at the outer diameter of mandrel 401. Seal rings 466 insure a proper pressure buildup at the outer diameter of mandrel 401. Fluid pressure is then exerted upward on piston 417 compressing working spring 418. Housing 420 is displaced upwardly with the piston 417 causing shoulders 430 to retract collet fingers 440 which pulls collet heads 442 from support diameter 445 and allows collet heads 442 to be retracted into reduced diameter 432 of mandrel 434. Pulling tool 400 can then be removed from whipstock 600. The configuration of pulling tool 400 during the hydraulic release mode is illustrated in FIG. 9B.

Although the present invention has been described by several embodiments, various changes and modifications may be suggested to one skilled in the art. It is intended that the present invention encompasses such changes and modifications as fall within the scope of the present appended claims.

What is claimed is:

1. A tubing exit whipstock for directing movement of well tools from a first wellbore to a second wellbore extending therefrom, the whipstock comprising:

a generally cylindrical deflector body with a first passageway extending therein, the deflector body having a first end with a first tapered surface formed thereon to deflect the well tools into the second wellbore, and the deflector body having a second end with a first mechanical connector for attaching the deflector body to an orienting and locking device to releasably install the tubing exit whipstock at a selected downhole location in the first wellbore;

a second longitudinal passageway extending from the first end of the deflector body at least partially therethrough;

a generally cylindrical hollow core disposed within the second longitudinal passageway of the deflector body, the first longitudinal passageway extending through the hollow core, and a first fishing neck profile being formed within the first longitudinal passageway in the hollow core, the first fishing neck profile providing means for releasably coupling the hollow core with a first retrieval tool for removing the tubing exit whipstock from the selected downhole location in the first wellbore;

a second mechanical connector for releasably coupling the hollow core within the second longitudinal passageway of the deflector body;

a second fishing neck profile formed within the second longitudinal passageway of the deflector body;

the second mechanical connector providing means for releasing the hollow core from the second longitudinal passageway when a predetermined amount of force is applied by the first retrieval tool to the first fishing neck profile formed within the first longitudinal passageway; and the second fishing neck profile providing means for a second retrieval tool to engage the deflector body to remove the tubing exit whipstock from the selected downhole location.

2. A tubing exit whipstock for directing movement of well tools from a first wellbore to a second wellbore extending therefrom, the whipstock comprising:

a generally cylindrical deflector body with a longitudinal first passageway extending therein, the deflector body having a first end with a first tapered surface formed thereon to deflect the well tools into the second wellbore, and the deflector body having a second end with a mechanical connector for attaching the deflector body to an orienting and locking device to releasably install the tubing exit whipstock at a selected downhole location in the first wellbore;

a fishing neck profile formed within the first passageway between the first end and the second end of the deflector body, the fishing neck profile providing means for releasably coupling the deflector body with a retrieval tool for removing the tubing exit whipstock from the selected downhole location in the first wellbore; and the deflector body further comprising:

a debris barrier disposed on the exterior of the deflector body to prevent debris from interfering with releasing the tubing exit whipstock from the selected downhole location;

a first opening formed in the exterior of the deflector body between the debris barrier and the first end of the deflector body, and a second opening formed in the first passageway; and a second passageway extending between the first opening and the second opening to allow fluid to bypass the debris barrier as the whipstock moves through the first wellbore.

3. A whipstock for directing movement of well tools from a first wellbore to a second wellbore extending therefrom, the whipstock comprising:

a generally cylindrical deflector body with a longitudinal first passageway extending therein, the deflector body having a first end with a first tapered surface formed thereon to deflect the well tools into the second wellbore, and the deflector body having a second end with a mechanical connector for attaching the deflector body to an orienting and locking device to releasably install the tubing exit whipstock at a selected downhole location in the first wellbore;

a fishing neck profile formed within the first passageway between the first end and the second end of the deflector body, the fishing neck profile providing means for releasably coupling the deflector body with a retrieval tool for removing the tubing exit whipstock from the selected downhole location in the first wellbore; and the deflector body further comprising:

a debris barrier disposed on the exterior of the deflector body to prevent debris from interfering with releasing the tubing exit whipstock from the selected downhole location;

at least one second passageway extending in the deflector body;

the second passageway having a first opening for communicating with the exterior of the deflector body on one side of the debris barrier;

the second passageway having a second opening for communicating with the exterior of the deflector body on another side of the debris barrier; and a check valve disposed between the first opening and the second opening to prevent undesired fluid flow through the deflector body.

4. A tubing exit whipstock for directing movement of well tools from a first wellbore to a second wellbore extending therefrom, the whipstock comprising:

a generally cylindrical deflector body configured for releasable securement within a window portion of a tubing string disposed within casing in the first wellbore, the deflector body having a tool deflection surface formed on a first end, and a first passageway formed longitudinally in the deflector body and permitting fluid communication through the deflector body; and a debris barrier disposed externally on the deflector body, the deflector body further having a second passageway permitting fluid communication between the exterior of the deflector body, and the first passageway through a sidewall of the deflector body.

5. The tubing exit whipstock according to claim 4, wherein the second passageway permits fluid communication between the first passageway and the exterior of the deflector body intermediate the debris barrier and the first end.

6. The tubing exit whipstock according to claim 4, wherein the second passageway communicates with a fluid flow channel formed on the exterior of the deflector body.

7. The tubing exit whipstock according to claim 6, wherein the fluid flow channel is formed into the exterior of the deflector body and extends generally longitudinally therein.

8. The tubing exit whipstock according to claim 4, wherein the second passageway permits fluid communication between the first passageway and the exterior of the deflector body intermediate the debris barrier and a second end of the deflector body opposite the first end.

9. The tubing exit whipstock according to claim 8, wherein the deflector body further has a third passageway permitting fluid communication between the first passageway and the exterior of the deflector body intermediate the debris barrier and the first end.

10. The tubing exit whipstock according to claim 4, further comprising a check valve permitting fluid flow in one direction through the second passageway.

11. A tubing exit whipstock for directing movement of well tools from a first wellbore to a second wellbore extending therefrom, the whipstock comprising:

a deflector body having a first tapered surface formed on one end and a first passageway formed at least partially through the deflector body; and a core releasably disposed within the first passageway and having a second tapered surface formed thereon aligned with the first tapered surface.

12. The tubing exit whipstock according to claim 11, further comprising a second passageway permitting fluid communication longitudinally through the deflector body and the core.

13. The tubing exit whipstock according to claim 12, wherein a first fishing profile is formed internally in the second passageway within the core, and wherein a second fishing profile is formed internally in the first passageway within the deflector body.

14. A tubing exit whipstock for directing movement of well tools from a first wellbore to a second wellbore extending therefrom, the whipstock comprising:

a generally tubular body having first and second opposite ends and an opening formed through a sidewall of the body between the first and second ends; and a deflector body attached to the tubular body and extending within the tubular body, a tool deflection surface of the deflector body being aligned with the opening, whereby the tubing exit whipstock is reciprocably receivable within a tubular string positioned within the first wellbore.

15. The tubing exit whipstock according to claim 14, wherein the tubular body has a first fishing profile formed internally at the first end.

16. The tubing exit whipstock according to claim 15, wherein the deflector body has a second fishing profile formed therein.

17. The tubing exit whipstock according to claim 14, wherein the tool deflection surface is releasably connected to a portion of the deflector body, the tool deflection surface being retrievable from within the tubular body separate from the deflector body portion.

* * * * *